United States Patent [19]

Frankel et al.

[11] 4,297,152

[45] Oct. 27, 1981

[54] ENERGETIC MONOPROPELLANT

[75] Inventors: Milton B. Frankel, Tarzana; Harry A. Arbit, Encino; Glen D. Artz, Canoga Park; John C. Gray, Ventura, all of Calif.

[73] Assignee: The United States of America as represented by the Secretary of the Air Force, Washington, D.C.

[21] Appl. No.: 110,888

[22] Filed: Jan. 10, 1980

[51] Int. Cl.[3] ..... C06B 25/00

[52] U.S. Cl. ..... 149/88; 149/119; 60/205

[58] Field of Search ..... 362/88, 119; 60/205

[56] References Cited

U.S. PATENT DOCUMENTS

| | | | |
|---|---|---|---|
| 3,873,626 | 3/1975 | Adolph | 149/88 X |
| 3,962,349 | 6/1976 | Adolph | 149/88 X |
| 4,050,968 | 9/1977 | Goldhagen et al. | 149/19.91 X |

*Primary Examiner*—Stephen J. Lechert, Jr.

*Attorney, Agent, or Firm*—Donald J. Singer; William J. O'Brien

[57] ABSTRACT

An energetic liquid monopropellant comprising a mixture of bis (2,2-dinitropropyl) acetal; bis (2,2-dinitropropyl) formal; and bis (2,2,2-fluorodinitroethyl) formal.

4 Claims, No Drawings

ENERGETIC MONOPROPELLANT

STATEMENT OF GOVERNMENT INTEREST

The invention described herein may be manufactured and used by or for the Government for governmental purposes without the payment of any royalty thereon.

BACKGROUND OF THE INVENTION

This invention relates to a novel comosition of matter which is useful as a liquid monopropellant for rocket motors. More particularly, this invention concerns itself with an energetic, thermally initiated, liquid, polynitro aliphatic monopropellant composed of a mixture of a geminate dinitro compound and a fluorodinitromethyl compound.

The increased interest in the use of rockets, missiles and other propulsion type devices has created a demand for more efficient propellant compositions. As is known, the primary function of a propellant is to impart motion to an object by means of a combustion reaction which transforms the propellant, either liquid or solid, into a gaseous form. The mechanism for effecting combustion differs for the various classes and types of propellants. In liquid propellants, flow rates, vaporization rates, droplet size and compositional content are important factors in the combustion reaction. Also, storage problems are of importance when using bipropellant compositions since the liquid fuel and liquid oxidizer components must be maintained in separate facilities until they are mixed in the combustion chamber.

Generally, liquid bipropellant compositions have greater performance capabilities than liquid monopropellants. However, the simplicity of using a monopropellant system and the elimination of its dual storage and flow facilities oftentimes is sufficient to justify the use of a monopropellant. This has been true even with present day state-of-the-art monopropellants such as hydrazine whose use has increased substantially over the years. The increase is due, primarily, to the development of a catalyst that will initiate and maintain its decomposition characteristics over a series of restarts. As a consequence, this fully characterized compound has found wide application and use in a number of aerospace systems. However, hydrazine is unsuitable for many potential monopropellant applications because of its low performance, high freezing point, and the catalyst requirement for the decoposition.

The economic benefits of an increased spacecraft payload resulting from the use of higher performance monopropellants is both obvious and significant. For example, a 20% increase in $I_s$ would permit a 17% increase in payload for a 2000-pound spacecraft. Less obvious is the benefit derived from a propellant having a low freezing point. This would permit the removal of the many heaters necessary to prevent hydrazine from freezing and, thereby, increase the usable payload. Also, additional benefits would accrue from a noncatalytic decomposition mode such as increased reliability, predictable and ensured service life, and elimination of high catalyst cost.

As a consequence, a research effort was initiated in an attempt to provide a new and improved monopropellant composition in order to take advantage of the benefits referred to above. This effort resulted in the discovery of the propellant composition of this invention which is capable of a theoretical performance at least 10 percent greater than anhydrous hydrazine. Also, it is characterized by a lower freezing point than hydrazine and is capable of decomposition without the need for catalysts.

SUMMARY OF THE INVENTION

In accordance with this invention, it has been discovered that monopropellant composition composed of a mixture of (A) a 50/50 weight ratio blend of bis (2,2-dinitropropyl) acetal and bis(2,2-dinitropropyl) formal, hereinafter referred to as BDNPA-F; and (B) (2,2,2-fluorodinitroethyl) formal, hereinafter referred to as FEFO. Although the components of the propellant composition maybe present in amounts ranging from 30 to 70 weight percent for either component, a weight ratio of 60 parts by weight of BDNPA-F to 40 parts by weight of FEFO has been found preferable.

Microthruster motor tests of the BDNPA-F/FEFO (60/40) mixture have shown that decomposition of the reactant mixture can be initiated and sustained by passage through a screen bed pre-heated to 800° C. Also, the monopropellant reactions proceed to near equilibrium, as indicated by measured corrected c coefficiencies in excess of 90%. No problems in handling or use of the reactant mixture were encountered and the feasibility of the BDNPA-F/FEFO reaction mixture as a thermally-initiated monpropellant was successfully demonstrated.

Accordingly, the primary object of this invention is to provide a new and improved liquid monopropellant composition.

Another object of this invention is to provide a liquid monopropellant that is capable of performing with at least a ten percent higher performance rating than hydrazine.

Still another object of this invention is to provide a liquid monopropellant that is characterized by possessing a lower freezing point and higher density than hydrazine.

These above and still other objects and advantages of the present invention will become more readily apparent upon consideration of the following detailed disclosure thereof.

DESCRIPTION OF THE PREFERRED EMBODIMENT

With the above-mentioned and other objects in mind, the present invention contemplates the formulation of a new and improved liquid monopropellant composition which possesses significantly higher performance characteristics than achieved heretofore by state-of-the-art liquid monopropellants such as anhydrous hydrazine. The specific composition contemplated by this invention is a mixture of specific polynitro components present in the mixture in predetermined ratios. The election of the monopropellant components for consideration in achieving the objects of this invention is based on a variety of interrelated factors. Obviously, it would be very difficult for a very high energy monopropellant to meet the performance and safety equirements desired for the most efficient operation. Therefore, a compromise in energy must be made to achieve a practical monopropellant with acceptable sensitivity. After consideration of all of the different types of compounds that have been evaluated as monopropellants, it was found that the polynitro aliphatic compounds still represented the best choice for fulfilling the above-cited monopropellant requirements. The key to successful utilization of polynitro aliphatic compounds lies in the judicious selection of their chemical structure, a criticl factor that has not been used to good advantage up to the present time.

The use of nitro, nitrato, and fluoronitro compounds as monopropellants has been the subject of many investigations. Nitromethane is the simplest compound in this series and has been studied in the greatest detail. Although nitromethane has a attractive theoretical performance of 245 seconds (1000 14.7 psia), it has been found to be too sensitive to various types of stimuli and suffers from poor combustion efficiency. It also has been determined that solutions of tetranitromethane and fluorotrinitromethane in nitromethane are too sensitive to be useful monopropellants. It is believed that the sensitivity of nitromethane is due to the labile hydrogen atoms, which are activated by the nitro group on the same carbon atom.

In general, it can be concluded that nitro or polynitroalkanes, containing activated hydrogen atoms, will be too sensitive or thermally unstable to be useful monopropellants. This is borne out by the known properties of such compounds as dinitromethane, 1, 2 dinitroethane, 1,1-dinitroethane, and trinitromethane as shown in Table I. This Table discloses the structure versus stability of nitroalkanes having the structural formula:

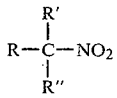

TABLE I

| Class of Compounds | Compound | R | R' | R'' | Remarks |
|---|---|---|---|---|---|
| Mononitro-alkanes | $CH_3NO_2$ | H | H | H | Sensitive |
| Dinitro-alkanes | $CH_2(NO_2)_2$ | H | H | $NO_2$ | Unstable |
| | $NO_2CH_2CH_2NO_2H$ | H | $CH_2$ | $NO_2$ | Limited Stability |
| | $CH_3C(NO_2)_2H$ | $CH_3$ | $NO_2$ | H | Thermally unstable |
| | $CH_3C(NO_2)_2CH_3$ | $CH_3$ | $NO_2$ | $CH_3$ | Stable Solid |
| Trinitro-alkanes | $HC(NO_2)_3$ | H | $NO_2$ | $NO_2$ | Unstable |
| | $CH_3C(NO_2)_3$ | $CH_3$ | $NO_2$ | $NO_2$ | Stable Solid |

It would be expected that replacement of the activated hydrogen atoms with stable atoms or groups would improve the sensitivity and thermal stability of the molecule. This is certainly the case when the hydrogen atom is replaced with a methyl group. Thus, 2,2-dinitropropane is a very stable compound and 1,1,1-trinitroethane is much more stable than nitroform. Unfortunately, both 2,2-dinitropropane and 1,1,1-trinitroethane are solids and not suitable as monopropellants.

After careful consideration of the known properties of polynitro aliphatic compounds, it can be concluded that the structural relationship between energy and stability (thermal and sensitivity) can be summarized as follows:

$$CH_3C(NO_2)CH_2- \quad FC(NO_2)_2CH_2- \quad (NO_2)_3CCH_2-$$

$$\xrightarrow{\text{Increasing Energy}}$$

$$\xleftarrow{\text{Increasing Stability}}$$

Thus, it would appear that viable monopropellant systems could best be achieved by the use of selected polynitro aliphatic compounds that provide the best compromise between energy and sensitivity with a desired low melting point range.

In evaluating the classes of polynitro aliphatic compounds, four classes were considered. These included the gem dinitro, fluorodinitromethyl, difluoro fluorodinitromethyl, and trinitromethyl compounds. The most attractive class was considered to be the formals for the following reasons. First, they are readily available on a production scale. Next they exhibit excellent physical properties suitable for monopropellant use and, finally, they possess a demonstrated use as energetic plasticizers in operational solid propellants and explosives systems.

The polynitro formals are prepared by the condensation of a polynitro alcohol with formaldehyde or acetaldehyde:

$$2\ RC(NO_2)_2CH_2OH \xrightarrow{CH_2O} [RC(NO_2)_2CH_2O]_2CH_2 + H_2O \qquad (I)$$

As a result of the evaluation of the various polynitroalphatics, it was discovered that a specific blend of certain compounds provided a preferred propellant that constituted the best compromise between energy and sensitivity together with an increase in performance and decrease in melting point over the hydrazine monopropellants utilized heretofore. The compositional content of the preferred propellant is a mixture of bis (2,2-dinitropropyl) acetal, BDNPA; bis (2,2-dinitropropyl) formal BDNPF; and (2,2,2-fluorodinitroethyl) formal, FEFO. These compounds are present in the mixture in amounts of (A) 30 to 70 parts by weight of a 50-50 weight ratio blend of BDNPA and BDNPF, hereinafter referred to as BNNPA-F and (B) from 30 to 70 parts by weight of FEFO. Based on availability, thermochemical calculations, and evaluation of physical properties and sensitivity, the best monopropellant candidate was BDNPA-F/FEFO (60/40). The properties of this mixture indicate that this system is capable of meeting the objectives of a monopropellant with 10% higher performance than hydrazine, with a lower freezing point and with a higher density than hydrazine. In addition, the thermal stability and sensitivity appear to be quite adequate.

Table II sets forth data for the 60 BDNPA-F/40 FEFO monopropoellant of this invention while Table III discloses various properties of the components which comprise the propellant mixture of this invention.

TABLE II

| | |
|---|---|
| Propellant Composition | |
| BDNPA-F— $[CH_3C(NO_2)_2CH_2O]_2CHCH_3/[CH_3C(NO_2)_2CH_2O]_2CH_2$(50/50) | |
| FEFO— $[FC(NO_2)_2CH_2O]_2CH_2$ | |
| Physical Properties | |
| Freezing Point: | −10 to −15 C. (Glasses) |
| Density: | 1.468 g/cc |
| Viscosity: | 9.2 CTS at 170 F. |
| | 20.4 CTS at 120 F. |
| | 53.4 CTS at 81 F. |
| | 447.8 CTS at 30.5 F. |
| Thermal Stability (DSC) | |
| Initial Exotherm: | 190 C. |
| Peak Exotherm: | 260 C. |
| Sensitivity | |
| U-Tube | |

TABLE II-continued

| | |
|---|---|
| Driving Pressure (Pd): | 535 |
| Pressure Ratio (Pd/Pi): | 38.8 (Ethyl Nitrate = 7.2) |
| Critical Diameter: | >1.0 in |
| Card Gap | |
| 70 Cards: | Negative |
| 50 Cards: | Negative |
| 20 Cards: | Borderline |
| Theoretical Performance (Shifting Equilibrium ($P_c$ = 100 psi) | |
| $T_c$, °K. | 2497 |
| c*, ft/sec | 4780 |
| $I_{vac}(\epsilon = 40)$, sec | 272.0 (Hydrazine = 247.7) |
| $I_{vac}(P_c = 0.1)$, sec | 277.7 |
| Carbon (Weight %): | |
| Chamber | 0 |
| Exit ($\epsilon$ = 40) | 0.54 |
| Exit ($P_c$ = 0.1) | 1.43 |

TABLE III

| Formal | BDNPA-F (50/50) $[CH_3C(NO_2)_2CH_2)]_2CHCH_3$ | FEFO |
|---|---|---|
| Structure | $[CH_3C(NO_2)_2CH_2O]_2CH_2$ | $[FC(NO_2)_2CH_2O]_2CH_2$ |
| Formula | $C_{7.5}H_{13}N_4O_{10}$ | $C_5H_6F_2N_4O_{10}$ |
| Molecular Weight | 319 | 320 |
| Freezing Point, C. | −5 to −15 | 14 |
| Boiling Point, C./mm | 150/0.01 | 110/0.3 |
| Vapor Pressure, (25 C.) | 0.16 | 0.16 |
| Density, g/cm$^3$ (25 C.) | 1.39 | 1.59 |
| $\Delta H_f$, kcal/mol | 46.36* | −178 |
| Thermal Stability vts (cc gas/g/ 22 hours/120 C.) | 0.2 | . 0.16 to 0.4 |
| Impact Sensitivity kg/cm | — | 65 |

*kcal/100 g

The bis (2,2-dinitropropyl) acetal, BDNPA; and the bis (2,2-dinitropropyl) formal, BDNPF of this invention are prepared in accordance with equations (II) and (III) as follows:

$$2CH_3C(NO_2)_2CH_2OH \xrightarrow{CH_2O} [CH_3C(NO_2)_2CH_2)]_2CH_2,\ \text{BDNPF} \quad (II)$$

$$2CH_3C(NO_2)_2CH_2OH \xrightarrow{CH_3CHO} [CH_3C(NO_2)_2CH_2O]_2CHCH_3,\ \text{BDNPA} \quad (III)$$

The bis (2,2,2-fluorodinitroethyl) formal (FEFO) was prepared by the condensation of fluorodinitroethanol and formaldehyde in accordance with equation IV as follows:

$$2FC(NO_2)_2CH_2OH \xrightarrow{CH_2O} \underset{\text{FEFO}}{[FC(NO_2)_2CH_2O]_2CH_2} \quad (IV)$$

The properties of these polynitro formals are summarized in Table III. As a class, these formals have high density with melting points ranging from −17° to 14° C., and excellent thermal stability. From a sensitivity standpoint, BDNPA-F is insensitive while the more energetic FEFO is more sensitive.

Detonation tests pf BDNPA-F have been conducted at 35° F. with approximately 80 to 90 pounds of BDNPA-F contained in an 8-inch OD by 32-inch-long, Schedule 40, iron pipe sleeve, and initiated with a No. 8 blasting cap and 30 grams of tetryl booster. Under these test conditions, the BDNPA-F did not detonate. Propagation of fire tests were also carried out on BDNPA-F in tubes and open pans at ambient and elevated temperatures. It was determined that fire would not propagate in the 1-inch or ½-inch diameter tubes, even though the samples were heated as high as 210° F. The test results also indicated that the combustion of BDNPA-F would not transfer from deflagration to detonation.

Detonation tests have shown that FEFO will undergo both the normal high velocity etonation (HVD), which usually propagates at 6 to 8 mm/msec, and low velocity detonation (LVD), which usually propagates at 2 to 3 mm/msec. However, blending FEFO with BDNPA-F constitutes a viable monopropellant system since the FEFO is densenitized as a result of the blending of components.

In order to determine the effectiveness of the propellant of this invention, theoretical performance calculations were first carried out on hydrazine, since it is the standard of reference. Although the delivered performance of monopropellant hydrazine can vary considerably depending on the amount of ammonia decomposed in the overall decompositions process, $$N_2H_4 \xrightarrow{100\%\ NH_3\ \text{decomposition}} N_2 + 2H_2$$

$$N_2H_4 \xrightarrow{50\%\ NH_3\ \text{decomposition}} \tfrac{2}{3}\,NH_3 + \tfrac{2}{3}\,N_2 + H_2$$

$$N_2H_4 \xrightarrow{25\%\ NH_3\ \text{decomposition}} NH_3 + \tfrac{1}{2}\,N_2 + \tfrac{1}{2}\,H_2$$

the performance of most of the operational hydrazine systems (which employ catalytic decomposition as opposed to thermal decomposition) is based on the decomposition of 30 to 40% of the theoretically available ammonia. The results of these calculations are summarized in Table IV.

TABLE IV

| | % $NH_3$ Decomposition | | | | | |
|---|---|---|---|---|---|---|
| Frozen Equilibrium | 100 | 75 | 50 | 35 | 25 | 0 0 |
| $T_c$, K | 871 | 1070 | 1273 | 1395 | 1474 | 1669 |
| c* | 3960 | 4200 | 4361 | 4407 | 4413 | 4349 |
| $I_{vac}(\epsilon = 40)$ | 211.7 | 227.5 | 241.1 | 247.7 | 251.4 | 256.5 |

An $I_{vac}$ ($\epsilon$=40) of 247 seconds, at a 35% ammonia decomposition, was selected as the hydrazine standard. Thus, an $I_{vac}$ ($\epsilon$=40) of 272 seconds 10% improvement) would be the foal for the new candidate monopropellants.

Calculations were then carried out on the propellants blend of this invention and the results as summarized in Table V, indicate that the objectives of this invention have achieved a system with optimum amounts of about 50 to 60 percent BDNPA-F with the balance FEFO.

TABLE V

| Shifting Equilibrium ($P_c$ = 100 psi | Composition, weight % BDNPA-F/FEFO | | | | |
|---|---|---|---|---|---|
| | 70/30 | 60/40 | 50/50 | 40/60 | 30/70 |
| $T_c$, K | 2331 | 2497 | 2659 | 2809 | 2932 |
| C* | 4679 | 4780 | 4872 | 4953 | 5018 |
| $I_{vac}$ ($\epsilon$ = 40) | 266.4 | 272.0 | 277.9 | 283.6 | 288.9 |
| $I_{vac}$ ($P_c$ = 0.1) | 272.9 | 277.7 | 282.7 | 288.2 | 293.9 |
| Carbon, weight % | | | | | |
| Chamber | 0 | 0 | 0 | 0 | 0 |
| Exit ($\epsilon$ = 40) | 1.46 | 0.54 | 0 | 0 | 0 |
| Exit ($P_c$ = 0.1) | 2.46 | 1.43 | 0.44 | 0 | 0 |

The freezing point of the components of the propellant mixture as well as the 50-50 blend is disclosed in Table VI.

TABLE VI

| Mono-propellant Candidate | Purity by GC | BP (C./min) | FP (C.) | DTA (C.) (at 10° C./min) Density (q/cc) | Initial Exotherm | Peak Exotherm |
|---|---|---|---|---|---|---|
| BDNPA-F | 99.0 | 150/0.01 | −5 to −18 | 1.39 | 203 | 236 |
| FEFO | 99.0 | 110/0.3 | 14 | 1.59 | 213 | 266 |
| 50BDNPA-F/50FEFO | — | — | −5 to −8 | 1.49 | 1.90 | 260 |

As can be seen, blending the components to form the 50-50 mixture decrease the freezing point. The density of the propellant ingredients as well as their thermal stability, are also set forth in Table VI, showing their excellent compatibility as a mixture. The U-tube adiabatic compression sensitivity test was used as the major criterion in evaluating the sensitivity of the monopropellant because it most closely reflects the conditions that a monopropellant encounters in actual use.

The U-table adiabatic compression tester consisted of a U-shaped tube closed at one end and containing a slug of test liquid in the curvature of the tube. The test is conducted by suddenly pressurizing the open end of the tube, which forces the liquid slug violently into the closed end. Peak pressures many times greater than the driving pressure are attained in the closed end of the tube. The U-tube test has several advantages over the dropweight test. The major advantage is that elastomeric seals are not required because the liquid slug acts as the piston. The only solid material in contact with the test fluid is the metal tube itself. A series of calibration tests were initially conducted with ethyl nitrate to check the operation of the tester. The 50% positive-driving-pressure ratio of ethyl nitrate was determined to be 7.2, which is in agreement with previous data.

Presented in Table VII are the results of the U-tube tests on monopropellant, which was run at ambient temperature. In examining the data in Table VII the following trends can be noted.

Sensitivity of the neat monopropellant candidates is as predicted with the gem-dinitro compounds (BDNPA-F) being the least sensitive, and the fluorodinitro compound, FEFO being more sensitive. However, blending FEFO with BDNPA-F gave some unexpected and surprising results. The 70BDNPA-F/30FEFO composition was negative at a pressure ratio of 108.7 (Run 13). Although FEFO is more sensitive in the neat state, when mixed with BDNPA-F the reverse holds true. By the same token, diluting FEFO with inert ingredients such as diethylene glycol (DEG) or dioxane did not have a marked effect on improving the sensitivity of FEFO (Runs 7 and 8). In summary, the blends of BDNPA-F with FEFO represent a desirable candidate monopropellant system, which achieves the objectives of this invention.

TABLE VII

| Run No. | Composition | Driving Pressure ($P_d$) psig | Pressure Ratio $P_d/P_i$ | Remarks |
|---|---|---|---|---|
| 1 | Ethyl Nitrate | 100 | 7.2 | 50% |
| 2 | BDNPA-F | 1000 | 72.5 | Negative |
| 3 | FEFO | 190 | 13.8 | 50% |
| 4 | BDNPA-F/FEFO 50/50 | 340 | 24.6 | 50% |
| 5 | BDNPA-F/FEFO 70/30 | 1500 | 108.7 | Negative |
| 6 | BDNPA-F/FEFO 60/40 | 535 | 38.8 | 50% |
| 7 | FEFO/DEG 85/15 | 220 | 15.9 | 50% |
| 8 | FEFO/Dioxane 85/15 | 200 | 14.5 | 50% |

Critical diameter tests were conducted on the monopropellant. The critical diameter tests were conducted in accordance with ASTM D2451. In the critical diameter tests, various diameters of tubing are filled with propellant and an attempt is made to cause the propellant to detonate by use of a secondary detonating medium (the donor). The first sample tested was the 60/40 BDNPA-F/FEFO mixture. The ½-inch OD, 0.035-inch wall, 30-inch long test section was selected for the initial test. When tested, the b 1-inch self-donor section was peeled back about three inches by the primary donor but remained intact and there was no transfer to the test section. The test section was reclaimed with the propellant intact. Because the 1-inch self-donor section remained intact and did not transfer, the critical diameter of 60/40 BDPNA-F/FEFO is larger than one-inch.

The second sample tested was the 50/50 BDNPA-F/FEFO mixture. As a starting point, a ½-inch OD, 0.035-inch long test section was used. When tested, the 1-inch self-donor section was completely missing; however, the ½-inch test section was only slightly bent and still contained propellant. The third test again utilized the 50/50 mixture of BDNPA-F/FEFO but the test section was ¾-inch OD, 0.049-inch wall, 30 inches long. When tested, the 1-inch self-donor section was again destroyed. The ¾-inch section showed a ballooning for about one inch. Interpretation of the results from this test indicates the since the ¾-inch test section was still intact, the critical diameter of a 50/50 mixture of BDNPA-F/FEFO, therefore, is between ¾ and 1 inch.

Thermal ignition tests were conducted on the following monopropellant candidates:

1. 70/30 BDNPA-F/FEFO
2. 60/40 BDNPA-F/FEFO
3. Neat BDNPA-F
4. Neat Hydrazine-Propellant Grade Candidates 3 and 4 were included as reference materials only. Simple single-droplet tests were performed by dropping a single drop of the candidate monopropellant onto a heated surface. Three different plate materials were used, offering a range of thermal conductivities. The plates were (1) pure copper 4 in.×4 in.×⅝ in., (2) 17-4 PH stainless steel 3 in. diameter×2 in. high and, (3) a procelain, perforated plate 4 in. diameter×¼ in. thick commonly used as the base plate in a small desiccator. The two metal plates had chromel-alumel thermocouples embedded in or near the geometric center of the plate. The porcelain plate was simply laid on top of the copper plate and its temperature was assumed to be the same as the copper plate after several hours heating time. The plates were heated in an electrically heated, cylindrical combustion furnance with both ends open. The plate temperature was determined by direct readout of the EMF produced by the thermocouple on a digital DC millivoltmeter. A standard thermocouple reference table was used to convert the millivolt readings to temperature in ° C. Since no reference junction was used and a °O C. reference junction table was used for conversion, the reported temperatures are probably approximately 20° C. lower than the actual temperature. No attempt was made to correct these temperatures since the variability of the data is quite large and the primary concern was for comparative data and not absolute temperatures.

Ignition delays were determined by frame counting of cinephotographic coverage from the time the droplet hit the plate unitl the first combustion light was visible. A camera speed of 200 frame/second was selected as optimum in order to see the droplet, the millivolt meter, and provide a reasonable degree of accuracy in time interval measurement. A back light shining through the furnace was used to illuminate the eyedropper and droplet as it fell to the plate. Over 100 individual droplet ignition delays were determined, as presented in Table VIII.

General conclusions derived from direct observation of the ignition tests and perusal of the ignition delay data are that there is little or no difference in the delay time observed as a function of the plate material used, except at the higher temperatures (above 550° C.) where shorter delays are observed with porcelain than with copper.

The longer delays observed at higher temperatures, especially with metal plates, are believed to be a function of heat transfer rate and droplet vaporization. Droplets appear to dance around on the plate and frequenctly roll off the plate without ignition occurring. This phenomena is believed to be a result of the rapid vaporization of the propellant droplet, thus causing a cooling effect on the remaining liquid and producing a surrounding gaseous environment which does not ignite readily. This effect is significantly less pronounced with the porcelain plate, as noted above, thus lending credence to the heat transfer theory.

TABLE VIII

| 60 BDNPA-F/40 FEFO | | | 70 BDNPA-F/30 FEFO | | |
|---|---|---|---|---|---|
| Temp.[1] °C. | Ignition Delay[2] Msec | Plate[3] Material | Temp. °C. | Delay Msec | Plate Mater. |
| 321 | 1240 | Copper | 301 | 470 | Stainless Steel |
| 321 | 1240 | Copper | 301 | 435 | Stainless Steel |
| 324 | 2960 | Porcelain | 322 | 1140 | Copper |
| 324 | 2980 | Porcelain | 322 | 625 | Copper |
| 335 | 1600 | Porcelain | 340 | 1335 | Porcelain |
| 325 | 750 | Porcelain | 362 | 70 | Copper |
| 359 | 90 | Copper | 362 | 115 | Copper |
| 359 | 95 | Copper | 367 | 75 | Stainless Steel |
| 367 | 105 | Stainless Steel | 367 | 50 | Stainless Steel |
| 367 | 65 | Stainless Steel | 367 | 55 | Stainless Steel |
| 367 | 55 | Stainless Steel | 440 | 165 | Porcelain |
| 421 | 345 | Porcelain | 440 | 110 | Porcelain |
| 421 | 105 | Porcelain | 444 | 140 | Copper |
| 442 | 125 | Copper | 444 | 430 | Copper |
| 442 | 75 | Copper | 472 | 450 | Copper |
| 475 | 160 | Copper | 472 | 170 | Copper |
| 481 | * | Stainless Steel | 517 | 100 | Copper |
| 492 | * | Stainless Steel | 517 | 110 | Copper |
| 520 | 40 | Porcelain | 517 | 130 | Copper |
| 520 | 35 | Porcelain | 519 | 90 | Porcelain |
| 520 | 70 | Porcelain | 519 | 110 | Porcelain |
| 521 | 195 | Copper | 583 | 260 | Copper |
| 521 | 185 | Copper | 583 | 330 | Copper |
| 521 | 190 | Copper | 607 | 135 | Porcelain |
| 526 | 5 | Copper | 607 | 60 | Porcelain |
| 587 | 500 | Copper | 607 | 70 | Porcelain |
| 608 | 55 | Porcelain | | | |
| 608 | 95 | Porcelain | | | |
| 608 | 150 | Porcelain | | | |
| Neat BDNPA-F | | | NEAT $N_2H_4$ | | |
| 329 | 500 | Porcelain | 285 | 3000 | Porcelain |
| 329 | 510 | Porcelain | 387 | 325 | Porcelain |
| 365 | 120 | Copper | 517 | 560 | Porcelain |
| 365 | 125 | Copper | 517 | 230 | Porcelain |
| 424 | 105 | Porcelain | 610 | 55 | Porcelain |
| 424 | 120 | Porcelain | 610 | 55 | Porcelain |
| 424 | 120 | Porcelain | 610 | 95 | Porcelain |
| 440 | 35 | Copper | 610 | 150 | Porcelain |
| 440 | 40 | Copper | 611 | 30 | Porcelain |
| 466 | 270 | Copper | 611 | 30 | Porcelain |
| 466 | 55 | Copper | | | |
| 466 | 235 | Copper | | | |
| 603 | 105 | Porcelain | | | |

[1]Temperature measured with chromel-alumel thermocouple embedded in center of metal plates. Porcelain plate placed on top of copper plate, temperature assumed same as copper.
[2]Ignition delay is time from droplet impact on plate to first light.
[3]Plate materials were: copper, 4 in. × 4 in. × 1 in.; 17-4PH stainless steel, 3 in. D × 2 in. H; porcelain plate out of desiccator, 4 in. D × ¼ in. H.

Minimum ignition delays are observed near 500° C. except for hydrazine which appears to be nearer 600° C. This is encouraging and indicates thermal ignition should present no problem in the motor tests. Because fairly low ignition temperatures are observed, heat feedback from combustion in the motor should also be sufficient for continuous operation. Temperatures above 600° C. are difficult to obtain in the device used for the ignition tests; however, this does not appear to present a problem since reasonable ignition delays were shown below 600° C. Microthruster motor tests were also conducted with the objectives of determining experimentally, for the selected candidate monopropellant composition (BDNPA-F/FEFO 60:40), whether thermal bed ignition is feasible and whether monopropellant decomposition is sustained and reproducible. If so, ignition delay time and characteristic exhaust velocity (c*) efficiency were to be measured. The microthruster test design was based on experience with monopropellant hydrazine thermal bed thrust chambers. The critical design factors were: (1) an injection process which prevented heating of the reactant liquid prior to its injection, atomization, and contact with the thermal bed in the combustion chamber; (2) provision of a thermal bed which had large surface area and low pressure drop and which could be heated rapidly and uniformly; (3) ultra-conservative safety factors since the pre-test chamber temperatures which might be required and the decomposition behavior of the candidate monopropellants were not known; and (4) allowance in the injector design for the high viscosity of the reactant liquids.

To satisfy the last requirement, flow test of BDNPA-F/FEFO 60:40 through 0.027-inch-diameter tubes were carried out. Measured discharge coefficients at pressure differentials of 100 to 200 psi were in the range 0.13 to 0.20. Design parameters for the microthruster are shown in Table IX.

TABLE IX

| Test reactant: | BDNPA-F/FEFO 60:40 |
|---|---|

TABLE IX-continued

| | |
|---|---|
| Nominal chamber pressure: | 150 psia |
| Nominal flowrate: | 0.05 lb/sec |
| Combustion chamber diameter: | 1.0 inch |
| Pre-test thermal bed temperature: | 8000° C. (1472 F.) |
| Thermal bed loading factor: | 0.064 lb/sec-in.$^2$ |

The microthruster consisted of a 1.00 inch ID CRES chamber, 7.50-inches long, with 0.565-inch walls. An orifice nozzle (0.234-inch throat diameter) was machined at the chamber exit, making the overall thruster length 8.10 inches. The chamber was packed with 420 Inconel-600 screens for 7.0 inches of its length. The screens were pressure-packed into the chamber at 2000 psi to ensure minimum void volume. The upstream half of the screen bed consisted of 30-mesh screen (0.010-inch-diameter wire); the downstream half of the bed was 20-mesh screen (0.010-inch-diameter wire). The injector consisted simply of three showerhead tubes (0.125-inch OD×0.0425-inch wall×2.20-inch length) welded directly into the chamber inlet and supplied from a 0.25-inch manifold. The latter was cooled by circulation of cold water through 0.125-inch external copper coils. This effectively prevented conduction of heat from the chamber to the fluid supply system during the pre-test heating period. Thruster instrumentation consisted of two temperature measurements (one at the center of the thermal bed, about 2.2 inches from the chamber inlet, the other in the converging section between the screen retainer plate and the throat orifice) and one pressure measurement (also in the convergent section). Before each test, the thruster was heated by external clamshell heaters (1200 watts total power) to the desired thermal bed temperature.

In keeping with the fundamental purpose of the microthruster motor tests, which was to establish the basic capability of the energetic reactant mixture BDNPA-FEFO to function as a thermally-initiated monopropellant, and because these were the first controlled firing experiments with these compounds, the test facility and procedure were kept as simple as possible.

The test facility consisted essentially of a small run tank (a high-pressure, calibrated, glass sight gage) fitted with pressurization and vent systems and a remotely controlled solenoid main valve, which admitted the reactant mixture to the injection manifold and thence into the screen bed through the injection tubes. A blowdown test procedure was used, in which the sight gage run tank was charged with the total quantity of reactant to be used in the firing and flow through the pre-heated microthruster screen bed was continued to reactant depletion. This provided an automatic system purge (by the pressurizing $GN_2$) at the end of the test, with no need for a separate purge system and without the necessity for storing the monopropellant mixture in the run tank between tests.

Reactant flowrates were determined photographically by focusing a Millikan motion picture camera running at 400 frames/second on the sight gage during each firing. The camera was fitted with a timing light which produced 120 pips/second along the edge of the film to accurately establish camera speed. The number of motion picture frames between passage of the reactant liquid level across successive marks on the calibrated sight gage gave the flowrates. Test data were recorded on an oscillograph.

Six tests were carried out with BDNPA-F/FEFO 60:40. Results are summarized in Table X. In Test No. 1, with pre-test screen bed temperature of 500° C., the decomposition reaction was probably initiated but not sustained, although the small quantity of reactant used in this initial test makes this conclusion tentative. All subsequent tests were made with screen bed temperatures of 800° C. and with progressively larger amounts of reactant. Decomposition was initiated and sustained in every case. The time elapsed from the OPEN signal to the solenoid main valve until start of chamber pressure rise was about 70 to 90 msec. This is on the order of the time required for the somewhat viscous liquid to flow through the 2-inch, 0.040-inch-diameter injection tubes, so that the ignition delay time after the reactant contacted the screen bed was not greater than 5 to 10 msec. Chamber pressure rise was rapid, on the order of 10 to 20 msec to reach 90% of the stready state level.

Characteristic velocity (c*) measurements were obtained in Tests No. 5 and 6. (The other tests were either too short or encountered camera timing light malfunctions.) Measured chamber pressures and reactant flowrates were used to calculate observed c* values. These were corrected for heat loss to the thermal screen bed, which was by far the most sifnificant correction. The correction factor was estimated from the measured rate of temperature increase of the screen bed and its mass and heat capacity. This gave the rate of heat loss from the product gases to the screens, from which the correction factor was calculated. Heat loss correction data are listed in Table X. The measured c* efficiency, corrected for heat loss to the screen bed from the decomposition product gas, was approximately 92 to 95 percent. Because of the sizeable uncertainties in measuring the very low reactant flowrates and in estimating the substantial heat loss corrections, the tabulated c* efficiencies in these tests should be considered only as approximate values. Nevertheless, they clearly show that decomposition of the BDNPA-F/FEFO monopropellant reactant mixture proceeds essentially to theoretical equilibrium. Hence, with proper nozzle design, the specific impulse will also be high.

TABLE X

| Test No. | Screen Bed Temp. (°C.) | Total Weight of Reactant (g) | Test Duration (sec) | Chamber Pressure (psia) | Comment |
|---|---|---|---|---|---|
| 1 | 500 | 12 | — | — | Reaction apparently not sustained |
| 2 | 800 | 22 | 1.0 | 95 | Reaction initiated and sustained |
| 3 | 800 | 51 | 1.6 | 146 | Reaction initiated and sustained |
| 4 | 800 | 88 | 2.7 | 146 | Reaction initiated and sustained |
| 5 | 800 | 88 | 2.3 | 177 | (corrected) = 95% |
| 6 | 800 | 147 | 3.4 | 159 | (corrected) = 92% |

The microthruster motor tests of the BDNPA-F/FEFO(60/40) mixture disclosed that decomposition of the reactant mixture was initiated and sustained by passage through a screen bed pre-heated to 800° C. The nonpropellant reactions proceeded to near equilibrium, as indicated by measured corrected c* efficiencies in excess of 90%. No problems in handling of the reactant mixture were encountered in terms of toxicity. Low-frequency chugging associated with the particular feed system dynamics and hardware configuration occurred in the test firings. However, the feasibility of the BDNPA-F/FEFO reaction mixture as a thermally-initiated monopropellant was experimentally demonstrated.

Although the invention has been described with reference to specific embodiments, it should be understood to those skilled in the art that the invention is capable of a variety of alternative embodiments and that all such embodiments as claimed within the scope of the appended claims are intended to be included herein.

We claim:

1. A liquid monopropellant composition comprising a mixture of bis (2,2-dinitropropyl) acetal, bis (2,2-dinitropropyl) formal and bis (2,2,2-fluorodinitroethyl) formal.

2. A liquid monopropellant composition in accordance with claim 1 wherein said mixture comprises (a) about 30 to 70 weight percent of a 50—50 weight ratio blend of bis (2,2-dinitropropyl) acetal and bis (2,2-dinitropropyl) formal, and (b) the balance of said mixture substantially all bis (2,2,2-fluorodinitroethyl) formal.

3. A liquid monopropellant composition in accordance with claim 1 wherein said mixture comprises (a) about 50 to 60 weight percent of a 50—50 weight ratio blend of bis (2,2-dinitropropyl) acetal and bis (2,2-dinitropropyl) formal and (b) the balance substantially all bis (2,2,2-fluorodinitroethyl) formal.

4. A liquid monopropellant composition consisting essentially of a mixture of (a) about 60 weight percent of a 50—50 weight ratio blend of bis (2,2-dinitropropyl) acetal and bis (2,2-dinitropropyl) formal; and (b) about 40 weight percent of bis (2,2,2-fluorodinitroethyl) formal.

* * * * *

UNITED STATES PATENT AND TRADEMARK OFFICE

CERTIFICATE OF CORRECTION

PATENT NO. : 4,297,152

DATED : October 27, 1981

INVENTOR(S) : Milton B. Frankel et al

It is certified that error appears in the above-identified patent and that said Letters Patent are hereby corrected as shown below:

Column 1, line 15, "geminate" should read --geminal--.
Column 1, line 29, after the word "compositions" insert a comma --,--.
Column 1, line 35, after the word "the" insert the word --consequent--.
Column 1, line 35, cancel "its".
Column 1, line 36, cancel "oftentimes".
Column 1, line 36, before "sufficient" insert the word --often--.
Column 1, line 38, cancel the word "day".
Column 1, line 39, after the word "hydrazine" insert a comma --,--.
Column 1, line 39, cancel the word "whose".
Column 1, line 39, after the word "use" insert the phrase --of which--.
Column 1, line 40, after the word "maintain" insert the phrase --the hydrazine--.
Column 1, line 40, cancel the word "its".
Column 1, line 51, after the word "monopropellants" insert the word --are--.
Column 1, line 51, cancel the word "is".
Column 1, line 51, cancel the word "both".
Column 1, line 57, after the word "freezing" insert a comma --,--.
Column 1, line 57, after the word "freezing" cancel --and,--.
Column 1, line 57, after the word "thereby" cancel the comma --,--.

UNITED STATES PATENT AND TRADEMARK OFFICE

CERTIFICATE OF CORRECTION

PATENT NO. : 4,297,152
DATED : October 27, 1981
INVENTOR(S) : Milton B. Frankel et al It is certified that error appears in the above-identified patent and that said Letters Patent are hereby corrected as shown below:

Column 1, line 57, change the word "increase" to --increasing--.
Column 1, line 59, after the word "mode" insert a comma --,--.
Column 2, line 7, cancel the phrase "its has" and substitute therefore the phrase --a monopropellant composition has--.
Column 2, line 8, cancel the phrase "that monopropellant composition" and insert therefor --which is--.
Column 2, line 11, change the semicolon to a comma --,--.
Column 2, line 14, change the word "maybe" to the phrase --may be--.
Column 2, line 15, cancel the word "for" and insert the word --of-- in place thereof.
Column 2, line 23, after the letter "c" insert a raised asteric --*--.
Column 2, line 66, cancel the word "still".
Column 2, line 66, change the word "represented" to --represent--.
Column 3, line 10, after the numeral "1000" insert the word --to--.
Column 4, lines 10 and 11, after the word "formals" insert a comma --,--.
Column 4, line 13, after the word "use" insert a comma --,--.
Column 4, lines 27 and 28, after "sensitivity" insert a comma --,--.

UNITED STATES PATENT AND TRADEMARK OFFICE

CERTIFICATE OF CORRECTION

PATENT NO. : 4,297,152

DATED : October 27, 1981

INVENTOR(S) : Milton B. Frankel et al

It is certified that error appears in the above-identified patent and that said Letters Patent are hereby corrected as shown below:

Column 4, line 29, after "point" insert a comma --,--.
Column 5, line 34, change the semicolon ";" to a comma --,--.
Column 5, line 34, after the phrase "BDNPF" insert a comma --,--.
Column 5, line 55, after "density" insert a comma --,--.
Column 5, line 55, cancel the word "with".
Column 5, line 59, change the word "pf" to --of--.
Column 5, line 62, after the word "pipe" insert a comma --,--.
Column 5, line 62, cancel the phrase "sleeve, and".
Column 6, line 61, after the word "seconds" insert a --(--.
Column 6, line 62, "foal" should read --goal--.
Column 6, line 65, after the word "results" insert a comma --,--.
Column 6, line 65, cancel the word "as".
Column 6, line 67, after the word "have" insert the word --been--.
Column 6, line 67, after the word "achieved" insert the word --by--.
Column 6, line 68, after the phrase "BDNPA-F" insert a comma --,--.
Column 7, line 30, after the word "ingredients" insert a comma --,--.
Column 7, line 46, after the word "required" insert a comma --,--.

UNITED STATES PATENT AND TRADEMARK OFFICE

CERTIFICATE OF CORRECTION

PATENT NO. : 4,297,152

DATED : October 27, 1981

INVENTOR(S) : Milton B. Frankel et al

It is certified that error appears in the above-identified patent and that said Letters Patent are hereby corrected as shown below:

Column 7, line 54, change the word "monopropellant" to --monopropellants--.
Column 7, line 54, cancel the word "was run" and insert the phrase --were carried out--.
Column 7, line 64, after the word "Run" insert the phrase --No.--.
Column 7, line 64, change the numeral "13" to --5--.
Column 8, line 1, after the word "Runs" insert the phrase --No.--.
Column 8, line 19, after the word "monopropellant" change the period "." to a comma --,--.
Column 8, line 19, cancel the phrase "The critical diameter tests were conducted".
Column 8, line 24, change the word "The" to --A--.
Column 8, line 36, before the word "long" insert the phrase --wall, 30-inch--.
Column 8, line 44, cancel the phrase "interpretation of".
Column 8, line 44, change the word "the" to --The--.
Column 8, line 44, after the word "results" cancel the word "from" and insert the word --of-- therefor.
Column 8, line 45, change "indicates" to --indicate--.
Column 8, line 45, cancel the word "the" and insert the word --that-- therefor.
Column 8, line 47, cancel the comma after the phrase "BDNPA-F/FEFO".
Column 8, line 47, cancel the word "therefore" and the comma after the word "therefore".

UNITED STATES PATENT AND TRADEMARK OFFICE

CERTIFICATE OF CORRECTION

PATENT NO. : 4,297,152

DATED : October 27, 1981

INVENTOR(S) : Milton B. Frankel et al

It is certified that error appears in the above-identified patent and that said Letters Patent are hereby corrected as shown below:

Column 8, line 59, insert a comma --,-- after the word "copper".
Column 8, line 60, insert a comma --,-- after the word "steel".
Column 8, line 60, after the word "high" insert a comma --,--.
Column 8, line 61, change the phrase "porcelain, perforated" to --perforated porcelain--.
Column 8, line 61, after the word "plate" insert a comma --,--.
Column 8, line 61, after the word "thick" insert a comma --,--.
Column 9, line 7, before the word "reference" change the symbol "$^{o}$OC" to --O$^{o}$C--.
Column 9, line 16, change "unitle" to --until--.
Column 9, line 18, cancel the first comma and insert the word --and-- therefor.
Column 9, line 18, change the word "milivolt meter" to --milivoltmeter--.
Column 9, line 18, cancel the comma --,-- second occurrence.
Column 9, line 19, before the word "provide" insert the word --to--.
Column 9, line 26, cancel the phrase "perusal of".
Column 9, line 30, before the word "where" insert a comma --,--.

UNITED STATES PATENT AND TRADEMARK OFFICE

CERTIFICATE OF CORRECTION

PATENT NO. : 4,297,152

DATED : October 27, 1981

INVENTOR(S) : Milton B. Frankel et al

It is certified that error appears in the above-identified patent and that said Letters Patent are hereby corrected as shown below:

Column 9, lines 35 and 36, change the word "frequenctly" to --frequently--.
Column 9, line 37, change the word "phenomena" to --phenomenon--.
Colunn 10, line 30, after the word "hydrazine" insert a comma --,--.
Column 10, line 42, after the word "composition" insert a comma --,--.
Column 10, line 49, after the word "factors" insert a comma --,--.
Column 10, line 60, change the word "test" to --tests--.
Column 11, line 63, after the word "of" insert the phrase --timing pips--.
Column 11, line 63, cancel the phrase "motion picture frames".
Column 12, line 16, change the word "stready" to --steady--.
Column 12, line 23, change the word "sifnificant" to --significant--.

UNITED STATES PATENT AND TRADEMARK OFFICE

CERTIFICATE OF CORRECTION

PATENT NO. : 4,297,152

DATED : October 27, 1981

INVENTOR(S) : Milton B. Frankel et al

It is certified that error appears in the above-identified patent and that said Letters Patent are hereby corrected as shown below:

Column 12, in Table X, Test No. 5, before the phrase "(corrected)" insert --$\eta_c$*--.
Column 12, in Table X, Test No. 6, before the phrase "(corrected)" insert --$\eta_c$*--.
Column 12, line 61, change the word "nonpropellant" to --monopropellant--.
Column 13, line 5, cancel the word "to" and insert the word --by-- therefor.
Column 13, claim 1, line 3, after the word "formal" insert a comma --,--.
Column 13, claim 2, line 2, change the word "claim" to --Claim--.
Column 14, claim 3, line 2, change the word "claim" to --Claim--.

Signed and Sealed this

*Twenty-third* Day of *March 1982*

[SEAL]

*Attest:*

GERALD J. MOSSINGHOFF

*Attesting Officer*

*Commissioner of Patents and Trademarks*